US006212914B1

(12) United States Patent
Kolmes et al.

(10) Patent No.: US 6,212,914 B1
(45) Date of Patent: Apr. 10, 2001

(54) KNIT ARTICLE HAVING RAVEL-RESISTANT EDGE PORTION AND COMPOSITE YARN FOR MAKING RAVEL-RESISTANT KNIT ARTICLE

(75) Inventors: Nathaniel H. Kolmes; Danny Ray Benfield; Della Bonell Moore, all of Hickory; George Marion Morman, Jr., Moravian Falls; Richie Darnell Phillips; Eric Pritchard, both of Hickory, all of NC (US)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 09/293,574

(22) Filed: Apr. 16, 1999

(51) Int. Cl.[7] ..... D04B 9/58; A41D 19/00

(52) U.S. Cl. ..... 66/172 R; 2/162; 2/167; 66/174; 66/202

(58) Field of Search ..... 66/169 R, 170, 66/171, 172 R, 174, 202, 169 A; 2/16, 159, 162, 167; 57/350, 243, 245, 251, 206, 289

(56) References Cited

U.S. PATENT DOCUMENTS

| | | | |
|---|---|---|---|
| 1,766,776 | | 6/1930 | Chisholm . |
| 2,076,273 | | 4/1937 | Harris . |
| 2,281,647 | | 5/1942 | Whitehead . |
| 2,588,361 | | 3/1952 | Cooper . |
| 3,460,338 | | 8/1969 | Morrison . |
| 3,487,628 | | 1/1970 | Csok . |
| 3,669,046 | | 6/1972 | Fowler . |
| 3,828,544 | | 8/1974 | Alker . |
| 3,901,289 | | 8/1975 | Filter et al. . |
| 4,191,221 | | 3/1980 | Boyer . |
| 4,299,884 | | 11/1981 | Payen . |
| 4,644,741 | | 2/1987 | Gradinger et al. . |
| 4,750,339 | * | 6/1988 | Simpson, Jr. et al. ..... 66/172 R |
| 4,991,387 | | 2/1991 | Tashiro et al. . |
| 5,085,917 | | 2/1992 | Hodnett, III . |
| 5,178,630 | | 1/1993 | Schmitt . |
| 5,239,846 | * | 8/1993 | Kitarua et al. ..... 66/172 R |
| 5,403,644 | | 4/1995 | Fujisawa et al. . |
| 5,417,048 | | 5/1995 | Thomas . |
| 5,456,096 | | 10/1995 | Mitsumoto et al. . |
| 5,572,860 | | 11/1996 | Mitsumoto et al. . |
| 5,749,212 | | 5/1998 | Rees et al. . |

* cited by examiner

*Primary Examiner*—Danny Worrell
(74) *Attorney, Agent, or Firm*—Rhodes & Mason, P.L.L.C.

(57) ABSTRACT

A knit article having an edge portion subject to raveling including a plurality of knitting courses in said edge portion. Each of the edge portion knitting courses is knitted with at least one strand of a heat fusible yarn, the heat fusible yarn including: i. at least one low melt fiber strand; and ii. at least one additional strand. The low melt fiber strand and the other strand are combined by air interlacing to create a single combined strand and to expose a sufficient amount of the one low melt fiber strand to facilitate a bond to an adjacent yarn strand.

9 Claims, 1 Drawing Sheet

KNIT ARTICLE HAVING RAVEL-RESISTANT EDGE PORTION AND COMPOSITE YARN FOR MAKING RAVEL-RESISTANT KNIT ARTICLE

BACKGROUND OF THE INVENTION (1) Field of the Invention

The present invention relates to the field of making knit articles, and, more particularly to preventing the raveling of an edge portion of a knit article such as a knit glove.

(2) Description of the Prior Art

Knitting processes have been used to make a variety of products and garments for quite some time. This textile fabrication technique creates comfortable items that are pliable, have high extensibility and that are relatively inexpensive. Generally, knitting provides productivity and lead time advantages compared to weaving processes. Knitting machinery is better adapted to producing small lots of goods and provides a shorter lead time and quicker response to such orders. In many respects knitting processes are faster than wovens and offer the benefits of providing body sizes and full-fashioned garments. Other knitting advantages include the low initial capitol costs, the lack of a need for expensive yarn preparation, the small area of floor space required for the equipment and the need for fewer auxiliary machines during operation. Knitting processes have been carried out in the textile art in a wide range of natural and synthetic fibers and yarns.

Despite all these advantages, a knit garment or article, and in particular a knit glove, suffers from a drawback. Knit products are susceptible to raveling. Raveling is defined technically as the process of undoing or separating the knit of a fabric. The term also refers to the process of removing yarns consecutively from a fabric and, further, to a loose yarn that has been partially or wholly detached from a cloth. As a practical matter, it is known that a loose end extending from a knit product may be pulled and, under the right circumstances, an entire knit item may be pulled apart simply by pulling on the loose end.

For glove makers, this problem has been particularly troublesome. One approach for dealing with the problem involves an extra sewing step. After knitting, the edge portions of knit glove cuffs are sewn manually on serging machines to apply an overlock stitch designed to hold any loose ends of material in place. This overcast sewing typically is accomplished with a polyester, nylon or cotton yarn. It will be readily appreciated that the additional serging step is labor intensive and can add significantly to the manufacturing cost of the glove.

Another approach for addressing this problem involves the use of the fusible adhesive yarn of the type disclosed in U.S. Pat. No. 5,572,860 to Mitsumoto, et al., assigned to Nitto Boseki Company, Ltd. and Shima Seiki Company, Ltd. In the Mitsumoto yarn a spun core yarn and a heat fusible yarn are twisted with each other in the same or opposite twisting directions as that of the spun core yarn. The spun core yarn is composed of an elastic yarn and a non-elastic short fiber assembly extending in the direction of the elastic yarn. The non-elastic short fiber assembly encloses the circumference of the elastic yarn as a core. The non-elastic short fiber assembly is expanded and bent by the contraction of the elastic yarn. The fusible adhesive yarn attached to the short fibers is solidified into small blocks located in a form of dots such that the expanded short fibers cover the small blocks of solidified fusible adhesive yarn.

In commercial applications it is believed that this yarn typically has been produced using the combination of spandex and polyester and a low melt yarn. This combination produced favorable results with respect to eliminating the additional labor associated with the sewn-in yarn described above. Nevertheless, this yarn has a unique set of drawbacks. First, the need for three components in the yarn makes it a relatively high cost solution. The tension in the elastic component of the spun core yarn must be carefully controlled so as to produce just the right amount of expansion and opening of the short fiber assembly. The spandex component is provided with a silicone finish, which, even in minute quantities, can contaminate particular types of work areas. For example, controlled environment chambers used for automobile painting are particularly sensitive to silicone contamination arising from the spandex finish. Lastly, experience with fusible adhesive yarns of this type has shown that, after repeated washings, the internal bond created by the fusible yarn breaks down.

Another type of commercially available heat fusible yarn is comprised of an elastic core strand, one or more wrap strands of a non-elastic material such as textured polyester and a cover strand comprised of a heat fusible yarn. The heat fusible yarn is placed on the outside of the composite yarn structure so as to be in intimate contact with and more readily bond to adjacent yarn strands. A typical heat fusible yarn of this type is available from Supreme Corporation as style number 343. This yarn provides acceptable results but does require a two-step manufacturing process given the separate wrapping steps needed.

It follows that there is a need for a knit article incorporating a heat fusible composite yarn so as to address the raveling problems of knit products. The article and yarn should use readily available, low-cost components and manufacturing techniques and should be capable of being heat treated using existing equipment to prevent raveling of the edge portion of the article.

SUMMARY OF THE INVENTION

The present invention addresses the raveling problems in the edge portions of knit articles, particularly knit gloves, by providing a knit article incorporating a novel heat fusible yarn in the courses making up the edge portion of the article. A knit article made according to the present invention may have its edge portion or portions heat treated using existing equipment but at a lower overall cost. This is because the novel heat fusible yarn incorporated into the knit article is constructed of multiple air-interlaced strands. Unexpectedly, it has been found that even though the air interlacing process joins the multiple strands into a single combined strand that may be knit, the fairly open structure of the combined strand exposes a portion of the low melt yarn component and thus makes it available for bonding to adjacent yarns.

The heat fusible yarn provides numerous advantages that include, but are not limited to, the need for less material per unit length than prior art heat fusible yarns which include a low melt strand wrapped around the exterior of the yarn structure. The heat fusible yarn of the present invention may be created in a single manufacturing step using readily available, well-known components and manufacturing equipment. The yarn may be produced with a shorter lead time and with fewer manufacturing steps that prior art yarns. Although these advantages are discussed with respect to knit gloves herein, this yarn may be used with any knit article having an edge portion susceptible to raveling and capable of being heat set.

The present invention thus relates to a knit article having an edge portion subject to raveling including a plurality of knitting courses in the edge portion. Each of the edge portion knitting courses is knitted with at least one strand of a heat fusible yarn comprised of at least one strand made up of a low melt fiber and at least one additional strand. The low melt fiber and the additional strand are combined by air interlacing to create a single combined strand so as to expose a sufficient amount of the low melt fiber strand to facilitate a bond to an adjacent yarn strand in the knit structure.

In a preferred embodiment the low melt fiber is comprised of a material selected from the group consisting of polyethylene, polyethylene copolymers and polypropylene.

In a particularly preferred embodiment, the knit article is a glove and the heat fusible yarn is knitted in a cuff portion of the glove.

It is an object of the present invention to reduce the number of manufacturing steps required to create a raveling-resistant edge portion on a knit article such as a glove.

Another object of the present invention is to reduce the number of components and simplify the manufacturing process for a heat fusible yarn used to prevent the edge portions of a knit article from raveling.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENT

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multi filament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands.

Figure 1:
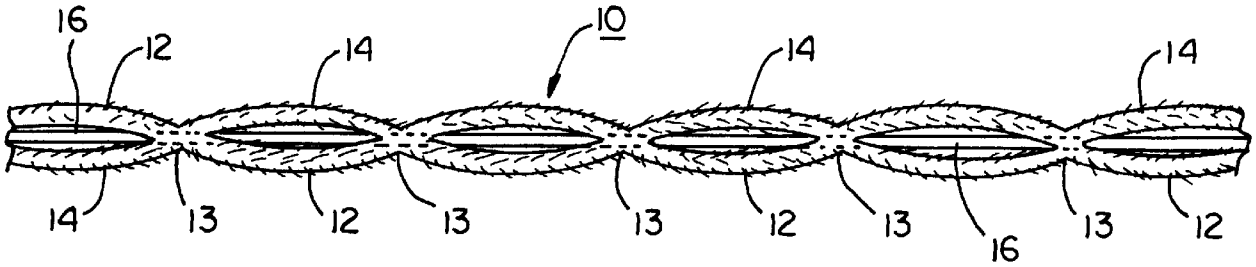
FIG. 1 is a schematic illustration of a multi-strand composite interlaced yarn used in the practice of the present invention.

A heat fusible yarn intended for use in the practice of the present invention is illustrated in FIG. 1. The yarn includes a plurality of strands which are combined using an air interlacing process. The strands 12,14,16 are interlaced with each other so as to form attachment points 13 intermittently along the length of the single combined strand 10. In a preferred embodiment, the combined strand 10 includes at least one strand of a low melt fiber 12 and at least one additional strand 14. Preferably, a plurality of additional strands 14, 16 are included.

The strands 12,14,16 may be air interlaced using well-known devices devised for that purpose. A suitable device is the SlideJet-FT system with vortex chamber available from Heberlein Fiber Technology, Inc. This device will accept multiple running multifilament and/or staple yarns and expose the yarns to a plurality of air streams such that the filaments of the yarns are uniformly intertwined with each other over the length of the yarn. This treatment also causes intermittent interlacing of the yarn strands to form attachment points between the yarn strands along their lengths. These attachment points have a length of between about 0.125 and about 0.375 inch depending on the yarn strand combination used. The number of attachment points per unit length of a combined interlaced strand will very depending on variables such as the number and composition of the yarn strands fed into the device. Neither the number of attachment points per unit length nor the length of those attachment points is critical so long as the other characteristics for the combined yarn as described herein are met. The practice of the present invention does not include the use of yarn overfeed into the air interlacing device.

As used herein, the term "low melt" refers to a yarn constructed of a material having a melting point that allows it to be used on commercial heat setting equipment to bond to and hold other yarns in a knit fabric structure in place. Various examples of such materials are known in the art. Preferably, the yarn will have a melting point of between about 175° F.–285° F. More preferably, the low melt yarn has a melting temperature between about 200° F.–225° F. Desirably, the low melt yarn is comprised of polyethylene, a polyethylene-based copolymer or another thermoplastic material such as polypropylene. A suitable low melt fiber is available from Fiber Science, Inc. of Palm Bay, Fla. as product 0501–200/12. It is believed that a multifilament low melt fiber provides better air interlacing performance. The low melt fiber need not be comprised entirely of fusible material such that the entire fiber would melt. For example, the low melt fiber could be comprised of a fiber having a high melt core and a low melt sheath. The low melt sheath may be applied using a coextrusion process. Alternatively, the low melt yarn may be a multifilament construction made of some low melt strands and some non-low melt strands. Either of the options just discussed is acceptable so long as a sufficient amount of the low melt fiber is presented for bonding to adjacent strands in a knit structure during heat setting.

The additional strand or strands may be comprised of any suitable man-made or synthetic fiber suitable for combination by air interlacing with the low melt fiber. Suitable materials include nylon, polyester, polyester-cotton blends, cotton, wool and acrylic. Other materials may be used so long as they are compatible with the selected low melt yarn and the final application of the knitted item whose edge portion will be protected from raveling. The denier of the additional strand or strands will vary depending on the equipment available and the desired final size of the composite yarn.

Table 1 below illustrates representative combinations of low melt fiber strands and additional strands that may be used in the practice of the present invention. In each of Examples 1–3 below the low melt fiber was the Fiber Science product described above provided in a 200 denier multifilament form. The terminology "_X" in the description of the yarn components refers to the number of strands of a particular component used to create a particular example.

TABLE 1

| Exp | Low Melt Fiber | Additional Strands | Approx. Overall Denier |
|---|---|---|---|
| 1 | 1X–FS | 2X–70 den polyester | 374 |
| 2 | 2X–FS | 3X–150 den polyester | 1021 |
| 3 | 2X–FS | 3X–70 den Textured Polyester | 711 |

The number of strands combined via the air interlacing process may be varied depending on a number of factors to include, but which are not limited to, the gauge of the knitting machine to be used, the desire to incorporate color, and the type of air interlacing equipment available. Table 2 below illustrates additional prophetic examples of yarns that may be created according to the present invention.

TABLE 2

| Exp | Low Melt Fiber | Additional Strands | Expected Overall Denier |
|---|---|---|---|
| 4 | 1X–70 den FS | 1X–70 den polyester | 150 |
| 5 | 1X–70 den FS | 1X–70 den nylon | 150 |
| 6 | 1X–200 den FS | 2X–70 den nylon | 350 |
| 7 | 2X–200 den FS | 3X–150 den nylon | 870 |

An acrylic may be substituted for the nylon or polyester in the prophetic examples above. It will be appreciated that if cotton or some other spun fiber is used it, that fiber will be provided in a size ranging from about 6 singles to about 36 singles.

Figure 2:
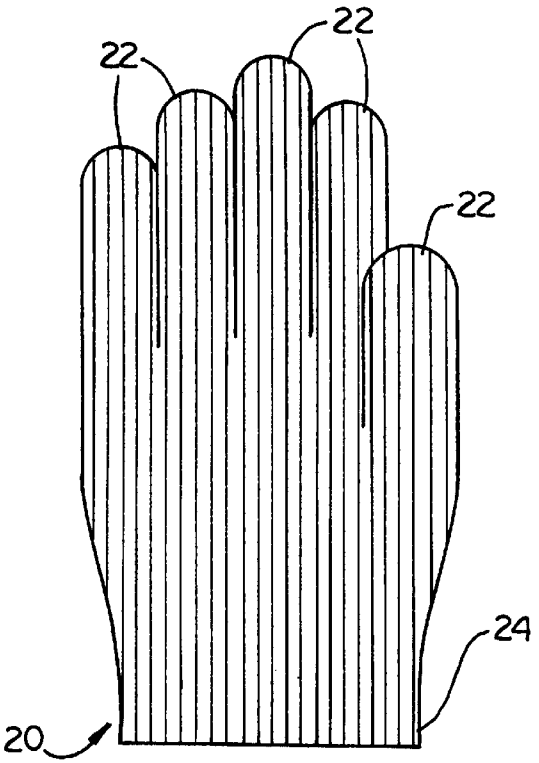
FIG. 2 is an illustration of a glove made according to the present invention.

A knit article constructed according to the present invention, in this case a glove 20, is illustrated in FIG. 2. The glove is constructed according to known glove making techniques and includes 5 finger stalls 22 and a cuff portion 24. The glove cuff 24 typically includes an elastic component to hold the glove securely on the wearer's hand. The yarn depicted in FIG. 1 is fed into the last 5–7 courses of the cuff as the glove is knitted. Suitable glove making machines for this purpose include those available from Shima Seiki. After knitting, the glove is then subjected to a heat setting treatment that causes the melting of the low melt yarn and thus locks the strands in the last several courses of the knit glove in place. Known machines for this step include those available from Shima Seiki and Matsushita Electrical Industrial Company. Machines from the latter company are available under the brand name VIKENAGA.

The present invention provides several advantages over prior art methods for preventing raveling in the edge portions of a knit article. These advantages include, but are not limited to, potentially significant labor savings. For example, when making the Supreme Style 343 wrapped heat fusible yarn described above, the wrapping yarn must be re-spooled before being used on the yarn wrapping machines. Currently, yarn manufacturers supply yarn on large capacity tubes weighing 25 pounds or more. These large packages are too heavy to fit known yarn wrapping machines. It follows that the yarn must unwound from the large packages onto smaller spools designed to fit the machinery used to make the wrapped yarn. This winding step is quite labor intensive. Moreover if the rewinding is not accomplished carefully, the yarn may break, thus increasing costs and processing time. In contrast, interlacing equipment may be fed directly from the large capacity packages without the need for an interim re-spooling step. An additional advantage that flows from the elimination of the additional winding step is the reduction in production time and lead time for product orders. The above-described advantages illustrate only a few of the benefits of the present invention. Other advantages, not listed here, will be readily apparent to one of ordinary skill and are included in the scope of the present invention.

Although the present invention has been described with preferred embodiments, it is to be understood that modifications and variations may be utilized without departing from the spirit and scope of this invention, as those skilled in the art will readily understand. Such modifications and variations are not discussed here for the purpose of brevity and clarity but are considered to be within the purview and scope of the appended claims and their equivalents.

What we claim is:

1. A knit article having a ravel preventing edge portion wherein:

a) at least some of the knitted courses in said edge portion include at least one heat fusible yarn;

b) said heat fusible yarn includes at least one low-melt strand and at least one additional strand formed of a higher melt material;

c) said at least one low-melt strand and said at least one additional strand extending in the same general longitudinal direction and being air-tacked at spaced points along the length thereof;

d) whereby said low melt yarn and said additional yarn become air-interlaced with a sufficient amount of the low-melt component being exposed that, upon heat treating, said low-melt material bonds to other yarns in the edge portion to prevent raveling.

2. A knit article according to claim 1 wherein said heat fusible yarn end comprises at least two additional strands.

3. A knit article according to claim 1 wherein said low-melt strand is at least partially formed of a material selected from the group consisting of polyethylene, polyethylene copolymers, and polypropylene.

4. A knit article according to claim 1 wherein said low-melt strand has a denier between about 50 and about 300.

5. A knit article according to claim 1 wherein said low-melt strand has a denier between about 175 and about 225.

6. A knit article according to claim 1 wherein said low-melt strand has a melting temperature between about 175° F. and 285° F.

7. A knit article according to claim 1 wherein said low-melt strand has a melting temperature between about 200° F. and 225° F.

8. A knit article according to claim 1 wherein said low-melt strand and said high-melt strand are continuous multi-filament strands.

9. A knit article according to claim 1 wherein said at least one additional strand is formed of a material selected from a group consisting of nylon, polyester, polyester cotton blend, cotton, wool and acrylic.

* * * * *